US005788549A

United States Patent [19]

Lee

[11] Patent Number: 5,788,549

[45] Date of Patent: Aug. 4, 1998

[54] METHOD OF MANUFACTURING COLOR CATHODE RAY TUBE

[75] Inventor: Jonghwan Lee, Seoul, Rep. of Korea

[73] Assignee: LG Electronics Inc., Seoul, Rep. of Korea

[21] Appl. No.: 678,696

[22] Filed: Jul. 11, 1996

[30] Foreign Application Priority Data

Jul. 28, 1995 [KR] Rep. of Korea ..... 1995-22927

[51] Int. Cl.[6] ..... H01J 9/44

[52] U.S. Cl. ..... 445/5; 445/6

[58] Field of Search ..... 445/6, 5

[56] References Cited

U.S. PATENT DOCUMENTS 3,323,854 6/1967 Palac ..... 445/5
3,966,287 6/1976 Liller ..... 445/6
4,052,776 10/1977 Maskell et al. ..... 445/5
4,214,798 7/1980 Hopen ..... 445/5
4,515,569 5/1985 Hernqvist ..... 445/6
4,567,400 1/1986 Opresko ..... 313/457
4,682,963 7/1987 Daldry et al. ..... 445/6
5,178,570 1/1993 Tomiyama et al. ..... 445/5

*Primary Examiner*—P. Austin Bradley
*Assistant Examiner*—Jeffrey T. Knapp

[57] ABSTRACT

A method of manufacturing a color cathode ray tube having an electron gun with plural electrodes is disclosed. The method includes the steps of aging a color cathode ray tube and knocking the aged color cathode ray tube, wherein in the knocking step, a high voltage is applied to the anode, a low voltage electrode is grounded, and the remaining electrodes are floated by a potential.

15 Claims, 3 Drawing Sheets

METHOD OF MANUFACTURING COLOR CATHODE RAY TUBE

FIELD OF THE INVENTION

The present invention relates to a method of manufacturing a color cathode ray tube, and more particularly to a method of manufacturing a color cathode ray tube capable of improving endurance voltage characteristic of each electrode by removing unnecessary substances in the tube without an injury of the neck.

DESCRIPTION OF THE PRIOR ART

In general, a color cathode ray tube comprises a phosphor screen to obtain a distinct picture and an electron gun which emits electron beams to collide on the phosphor screen. In order to provide the distinct picture, high voltage is applied to the electron gun and the phosphor screen.

When the high voltage is applied, however, it causes troubles that decrease the quality of the goods, like as the increase of the discharge phenomenon, the occurrence of the vacuum destruction accompanied with the sputter of interstitial electrode and the neck luminousness which are related with the electrode parts in the electron gun and the insulating parts (bead glass, neck tube), and X-ray emission in the neck tube.

The methods for solving the above-mentioned defects were suggested, and include, for example, the float knocking method published in U.S. Pat. No. 4,214,798 and the metallized bead method published in U.S. Pat. No. 4,567,400. But the progressive effects against these defects were not sufficiently obtained in these methods.

A general method of manufacturing the color cathode ray tube comprises the steps of sealing up the opening of the neck tube after inserting the electron gun into the neck tube, outwardly exhausting the air in the tube to create a vacuum state, and executing the spot knocking and aging.

When the sealing process is completed, the cleanness which means not to include unnecessary substances in the tube and the flatness of the electrode surface are absolutely necessary conditions. The reason is that the stray emission is generated in the unnecessary substances or the projected portion of the low voltage side of the electrodes, and the sputter is also generated due to the mutual collision of the electrons when a high voltage is applied to the electrodes.

In order to relieve the above-mentioned phenomena, the spot knocking process was suggested. The process removes or scatters unnecessary substances by applying a high voltage two or three times higher than the operating voltage for the color cathode ray tube to the electrode in step by step and then discharging the electron gun.

In general, there is a method for the cleanness of the electrode surface, in which electrodes of low and middle voltage are grounded and then knocking voltage of several times higher than the normal voltage is applied as direct current or pulse.

For example, in a case of an electron gun of uni-potential type, a first grid(G1), a second grid(G2) and a fourth grid(G4) are grounded, and the voltage of 60KV which is two times as high as the normal voltage, is applied. Also, in a case of an electron gun of uni-potential type having arc-suppressor electrode, a first grid(G1), a second grid(G2) and a fourth grid(G4) are grounded with an arc-suppressor, and a third grid(G3) and a fifth grid(G5) are grounded with the generation source of high voltage. Furthermore, in a case of an electron gun of bi-potential type, the low voltage electrodes G1, G2 and G4, and the middle voltage electrodes G3 and G5 are grounded, and high voltage is applied to the high voltage electrode G6.

U.S. Pat. Nos. 5,178,570 discloses the voltage division knocking method, which is to maximize the knocking effect due to the division of the voltage of the anode.

The above-mentioned various knocking methods have been known to be effective in the Braun tube of thirty inch and below to some degree, but there is a doubt about the knocking effect in the Braun tube of thirty inch and more.

Since the knocking methods have a difference according to the connection of electrodes in the electron gun, a method appropriate to the electron gun should be selected in order to remove unnecessary substance or to solve the stray emission.

In addition, in case that the electron gun has too many electrodes or the electrode is too long, unnecessary substances exist in each electrode so that there are problems that the conventional knocking methods have difficulty in solving.

SUMMARY OF THE INVENTION

An object of the present invention is to provide a method of manufacturing a color cathode ray tube capable of improving the endurance voltage characteristic of each electrode by removing unnecessary substances in the tube without an injury of the neck.

According to the invention, the method of manufacturing a color cathode ray tube including an electron gun having plural electrodes includes the steps of: aging a color cathode ray tube; and knocking the aged color cathode ray tube, wherein in the knocking step, a high voltage is applied to the anode, a low voltage electrode is grounded and the remaining electrodes are floated by a potential.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
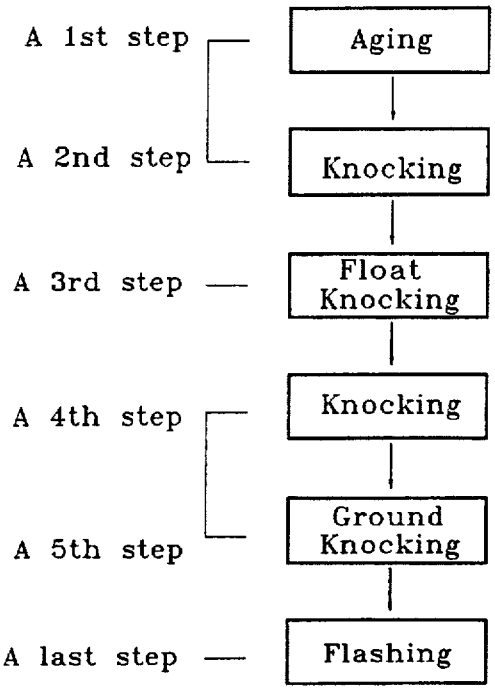
FIG. 1 is a flow diagram showing a method of manufacturing a color cathode ray tube according to an embodiment of the present invention.

Referring to FIG. 1, the method of manufacturing color cathode ray tube according to the present invention is illustrated.

As a first step, an aging process is performed before the knocking process. As a second step, a direct knocking method is performed, in which a high voltage of 45 to 65KV is applied to the high-voltage electrode and the remaining electrodes are grounded. As a third step, a G3 electrode-floating method is selected, in which a high voltage of 60 to 70KV is applied to the high-voltage electrode, the focusing electrode is floated by potential and the remaining electrodes are grounded. As a fourth step, an indirect knocking method of G3 electrode is performed, which connects resistors of several KΩ to MΩ with the external part of G3 electrode to induce high voltage to G3 electrode and grounds the remaining electrodes. As a fifth step, a G2 electrode-ground method is performed, in which a high voltage of 60 to 70KV is applied to high-voltage electrode, G2 electrode is grounded, and the remaining electrodes are floated. And, as the last step, the flashing process is performed, in which a voltage of 6.3 to 10.5V is applied to the heater during several hundreds seconds.

Figure 2:
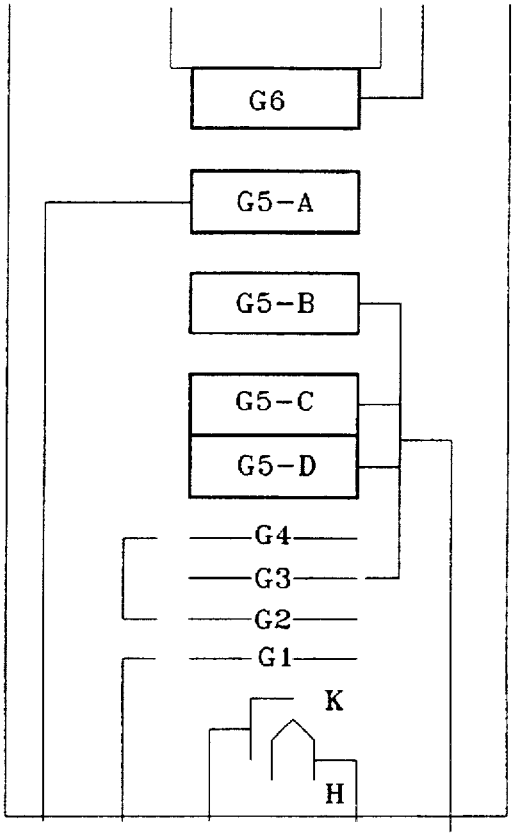
FIG. 2 is a connection diagram of the electron gun for color cathode ray tube capable of being applied to the present invention.

FIG. 2 is a connection diagram of the electron gun for a color cathode ray tube capable of being applied to the present invention and shows that the grid(G) is equipped to the interior of the neck part(A).

Hereinbelow, the method of manufacturing color cathode ray tube according to the present invention is illustrated in detail.

As the first step, the aging process is performed before the knocking process, which is to minimize the stray scattering due to the vaporization of Barium(Ba). In order to decrease the deposition of each electrode by Ba, the aging step is selected, in which thermal activation is performed at a low heater voltage than 10V and within the time of 5 minutes, and current activation selects the aging method in that G1 and G2 voltages are applied to the heater and the activation is completed within 30 minutes. And, the second step which performs direct knocking, is to remove unnecessary substance around the grid of FIG. 2 or not to generate stray emission. It is possible to apply DC voltage or pulse voltage to the high-voltage electrode of G6, wherein the high voltage has to be properly selected in order to avoid the generation of the sputter in the neck. The third step of G3 electrode-floating method is to obtain the knocking effect of G5, G4 and G3 electrodes. In the same manner as the second step, the third step also has to apply high voltage of DC or pulse selected within an appropriate range.

Figure 4:
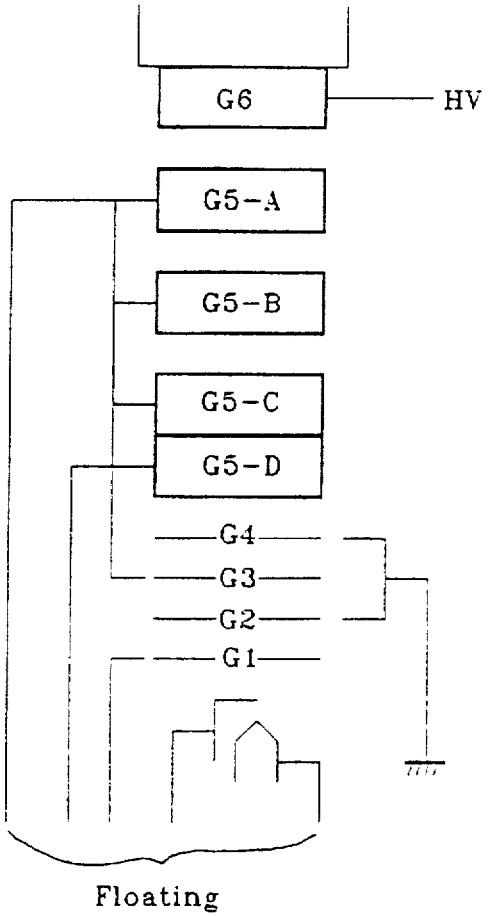
FIG. 4 is a connection diagram of the electron gun to which a second grid(G2)—ground knocking method is applied.

FIG. 4 is a connection diagram of the electron gun to which a second grid(G2)—ground knocking method having a pretty high effect for the cleanness of each electrode surface is applied. As shown in FIG. 4, since only G4 electrode is grounded, high voltage makes a part around G2 electrode discharged. And, since G3, G4 and G5 are floated, the knocking effect is obtained by the induced voltage. Accordingly, the second grid (G2)—ground knocking method makes each electrode cleaned conformably. It is possible to enhance the endurance voltage characteristic by applying the second method to the fifth process. After the knocking process, the flashing process for the recovery of the cathode emission ability is absolutely needed in a sixth process since the gas generated during the knocking process may cause the degeneration of the cathode emission. The flashing process prevents the injury due to the gas coating by applying the voltage of 6.3V to 10.5V to the heater during several hundreds seconds.

Figure 5:
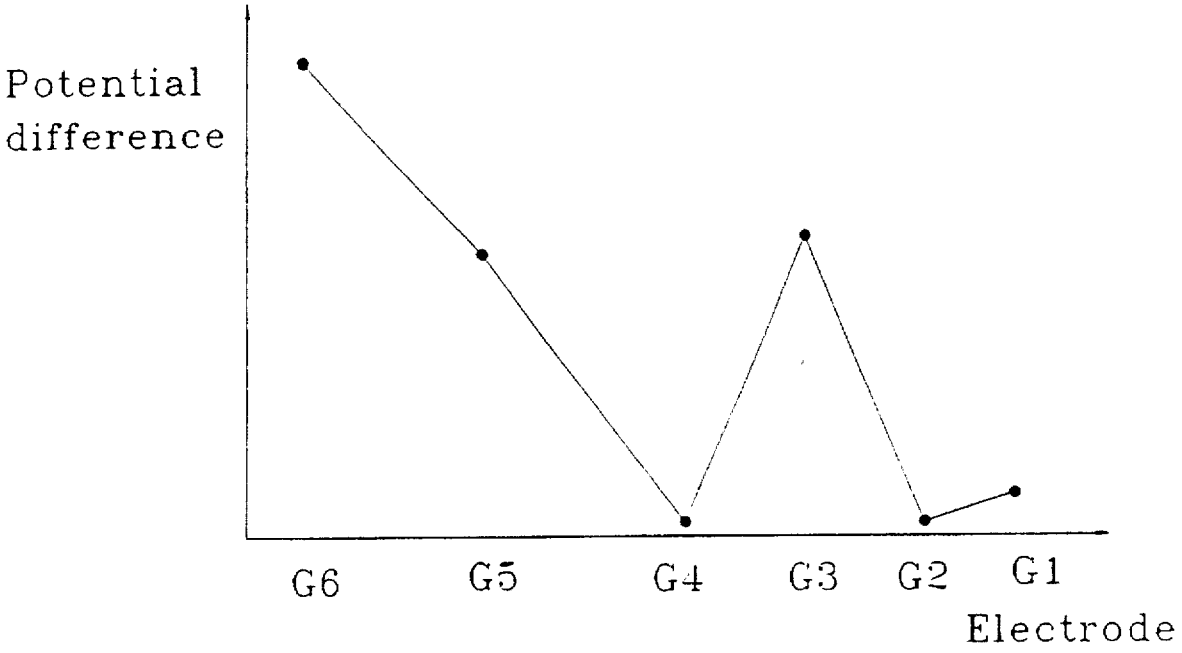
FIG. 5 is a distribution diagram of the potentials in a second grid(G2)—ground knocking method.

FIG. 5 shows a distribution of the potential in a second grid(G2)—ground knocking method. As shown in FIG. 5, since the potential difference exists between G5 and G4 electrodes, and G4 and G3 electrodes, the knocking effect due to the compulsory discharge can be anticipated.

Figure 3:
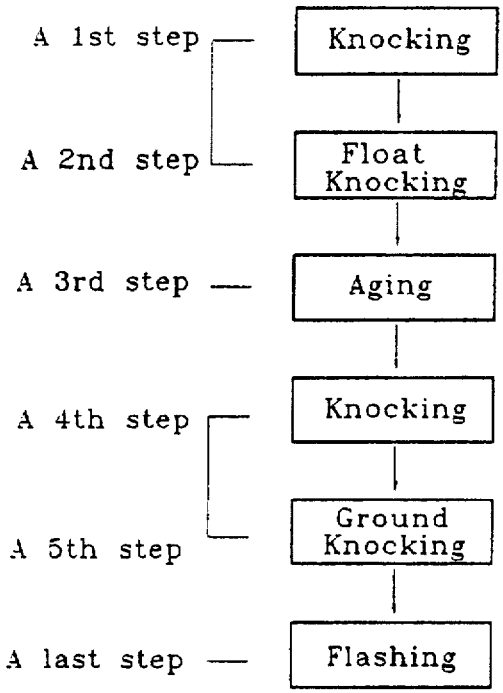
FIG. 3 is a flow diagram showing a method of manufacturing a color cathode ray tube according to another embodiment of the present invention.

FIG. 3 is a flow diagram showing a method of manufacturing a color cathode ray tube according to another embodiment of the present invention. As shown in FIG. 3, in case that a residual gas in the color cathode ray tube or polluted gas which is generated in the knocking process, is large in amount, the aging process is performed at the mid-term of a first and second knocking process because the gases affect on the ability of the cathode emission. At this time, direct knocking and G3—floating knocking methods are selected in the first knocking process, and indirect knocking and G2—ground methods can be selected in the second knocking process.

As previously described in detail, the present invention can be applied to all of the electron gun regardless of the structure of the electrodes or the connection thereof. In addition, since the present invention has a knocking effect to enhance the cleanness of each electrode surface as much possible in the electron gun, it can minimize a fall in quality of the goods. Furthermore, an enhancement in the endurance voltage characteristic and throughput can be anticipated by applying the art of the present invention for the fabrication of the electron gun.

As a result of the aging and knocking process in the cathode ray tube having the electron gun provided in FIG. 2, the starting voltage in G2 system is increased by 3KV and more, and in G3 system the starting voltage is increased by 5KV and more so that the generation ratio of the inferior goods is decreased.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of manufacturing a color cathode ray tube including an electron gun having plural electrodes comprising the steps of:

aging a color cathode ray tube; and knocking the aged color cathode ray tube, wherein the knocking step includes applying a high voltage to an anode, grounding a low voltage electrode and floating the remaining electrodes by a potential.

2. The method according to claim 1, wherein said aging step is performed at a heater voltage of less than 10V.

3. The method according to claim 1, further comprising an additional knocking step in which a high voltage is applied to the anode, a focusing electrode is floated by potential, and the remaining electrodes are grounded.

4. The method according to claim 1, further comprising an additional knocking step in which a high voltage is applied to the anode, an external part of a focusing electrode is connected to a resistor, and the remaining electrodes are grounded.

5. The method according to claim 1, wherein in the knocking step, the high voltage of 60KV to 70KV is applied to the anode.

6. The method according to claim 1, further comprising a step of applying a predetermined voltage to a heater.

7. The method according to claim 6, wherein the predetermined voltage applied to the heater ranges from 6.3V to 10.5V.

8. The method according to claim 1, further comprising an additional knocking step in which a high voltage is applied to the anode, and the remaining electrodes are grounded.

9. The method according to claim 8, wherein in the floating knocking step, the high voltage of 60KV to 70KV is applied to the anode.

10. The method according to claim 8, further comprising a floating knocking step in which a high voltage is applied to the anode, a focusing electrode is floated by a potential, and the remaining electrodes are grounded.

11. The method according to claim 10, further comprising an indirect knocking step in which a high voltage is applied to the anode, an external part of a focusing electrode is connected to a resistor, and the remaining electrodes are grounded.

12. The method according to claim 11, further comprising a flashing step in which a predetermined voltage is applied to a heater.

13. The method according to claim 12, wherein the floating knocking step is performed prior to the aging step.

14. The method according to claim 12, wherein the floating knocking step and the indirect knocking step are performed between the additional knocking step and the step of knocking the aged color cathode ray tube.

15. The method according to claim 14, wherein the flashing step is performed after the step of knocking the aged color cathode ray tube.

* * * * *